United States Patent [19]

Thomas et al.

[11] Patent Number: 4,481,404

[45] Date of Patent: Nov. 6, 1984

[54] TURN-OFF CONTROL CIRCUIT FOR SELF-CLEANING OVENS

[75] Inventors: Charles E. Thomas, Scotia; Robert J. Wojnarowski, Clifton Park, both of N.Y.

[73] Assignee: General Electric Company, Schenectady, N.Y.

[21] Appl. No.: 452,223

[22] Filed: Dec. 22, 1982

[51] Int. Cl.[3] ..... H05B 1/02

[52] U.S. Cl. ..... 219/398; 219/393; 219/396; 219/413; 219/483; 236/15 E

[58] Field of Search ..... 219/393, 398, 396, 413, 219/400, 397, 412, 483, 486, 10.55 B; 134/2, 19, 20; 126/21 A, 90 A; 236/15 E; 431/18, 76

[56] References Cited

U.S. PATENT DOCUMENTS

| | | | |
|---|---|---|---|
| 2,762,568 | 9/1956 | Sullivan | 236/15 |
| 2,862,095 | 11/1958 | Scofield | 219/393 |
| 3,413,444 | 11/1968 | Heit | 219/393 |
| 3,459,923 | 6/1969 | Harris, Jr. | 219/480 |
| 3,536,457 | 10/1970 | Henderson | 23/288 |
| 3,899,656 | 4/1975 | Smith | 219/413 |
| 3,936,659 | 2/1976 | Mainord | 219/413 |
| 3,951,603 | 4/1976 | Obayashi et al. | 23/232 E |
| 4,038,032 | 7/1977 | Brewer et al. | 23/230 A |
| 4,260,978 | 4/1981 | Yasuda et al. | 338/34 |
| 4,311,895 | 1/1982 | Tanabe | 219/497 |
| 4,316,068 | 2/1982 | Tanabe | 219/497 |
| 4,383,158 | 5/1983 | Niwa | 219/10.55 B |

*Primary Examiner*—C. L. Albritton
*Assistant Examiner*—Teresa J. Walberg
*Attorney, Agent, or Firm*—Geoffrey H. Krauss; James C. Davis, Jr.; Marvin Snyder

[57] ABSTRACT

In a cooking oven which is cleaned by pyrolyzation of soil within the oven cavity and has a smoke eliminator duct extending through the oven wall, with a smoke eliminator heater disposed adjacent to the duct inlet, a reducing gas sensor is mounted either adjacent to the oven end of the smoke eliminator duct or within the smoke eliminator duct near its discharge end. An electrical relay or microcomputer control is coupled between the gas sensor and the heater to initially heat the oven interior and to later deenergize the heater when the reducing gas sensor output indicates a desired oven condition. The oven heaters are temporarily deenergized when the gas sensor output indicate a smoke eliminator overload. If the gas sensor is mounted in the smoke eliminator duct, the smoke eliminator heater may be deenergized toward the end of the cleaning cycle, so that the effluent is not affected by the smoke eliminator heater before reaching the gas sensor. Plural smoke eliminator heaters are also disclosed to enable increase of heater power during the early cleaning stages and reduction of the heater power during the later cleaning stages.

20 Claims, 11 Drawing Figures

PRIOR ART STRUCTURE, PLUS SENSOR(S) OF PRESENT INVENTION 66
66a
VOLTAGE
TIME 67
67a
VOLTAGE
V1
V2
TIME
t1
t2

TURN-OFF CONTROL CIRCUIT FOR SELF-CLEANING OVENS

BACKGROUND OF THE INVENTION

This invention relates to cooking ovens, particularly those which are pyrolytically cleaned and more specifically relates to a novel control for such ovens to reduce oven cleaning time to that necessary to remove the existing food soil and to reduce the flow into the external atmosphere of unoxidized effluent from the pyrolytic cleaning process.

It is well known that smoke and other effluent is produced by cooking ovens during the cooking process and particularly during pyrolytic cleaning of the oven. Some effluent produced during cooking is desirable since it is the source of appetizing aromas. However, other cooking effluent and particularly all pyrolytic cleaning effluent, is undesirable. Many smoke eliminator systems are known to reduce effluent from the pyrolytic cleaning process. These provides an incidental benefit of reducing undesirable cooking effluent in some oven cleaning smoke elimination systems.

There are two principal approaches to automatic oven cleaning. The first is the continuous-clean system which employs a catalytic oven surface which promotes oxidation of food soil which drips and spatters on the oven walls during the cooking process. Due to the catalytic action, the food soil hydrocarbons are converted to carbon dioxide and water vapor with reasonable efficiency at temperatures near the maximum employed in the cooking processes which is about 500° F. If high-temperature cooking processes, such as broiling, are employed with sufficient frequency and no oven soil reaches oven surfaces (such as windows) which are not coated with the catalytic material, the oven will remain reasonably clean. This system also tends to reduce both desirable and undesirable cooking process effluent discharge into the room atmosphere.

The second approach may employ oven cavities having porcelain enamel interior walls and a glass viewing window, all of which collect food soil during normal cooking use of the oven. To burn off this soil, the oven heater coils are operated to raise the temperature of the oven internal surfaces close to 900° F., and usually to about 880° F., for an extended period. The process produces a considerable amount of undesirable effluent which is passed through a known type of smoke eliminator, contained in the oven wall, and is discharged into the room atmosphere.

The effluent which is produced by the pyrolytic oven cleaning process will contain a high percentage of partial pyrolytic products which are relatively simple volatile hydrocarbons produced from the complex solid food soil hydrocarbons by elevated temperatures. The composition of the effluent is related to the temperature-time profile of the cleaning process and to the type of food soil being cleaned. In a typical cleaning cycle, the greatest volume of effluent is produced fairly early in the cleaning cycle as the oven temperature first passes through the 600°-700° F. region, as the temperature is increased to the approximately 880° F. value which is maintained during most of the cycle. The remaining soil, however, must be treated for an extended period of time at the 880° F. temperature to complete the final removal of the carbon-rich soil remaining after the more volatile partial pyrolytic products have been driven off.

The smoke eliminator which vents effluent to the room atmosphere is provided with a heater which causes the oven output duct to have a temperature higher than that inside the oven chamber. Thus, the smoke eliminator can further oxidize oven effluent before it reaches room atmosphere. Moreover, the heater in the smoke eliminator tends to direct effluent through that duct, rather than to other possible exit routes, such as around the oven door, and causes the effluent to oxidize rapidly to the carbon dioxide and water vapor end products that are more desirable than the untreated effluent. The smoke eliminator heater keeps the effluent in the smoke eliminator duct about 100°-200° F. hotter than the internal oven temperature, when there is no exothermic reaction in the smoke eliminator. When effluent burns in the smoke eliminator, the duct temperature may rise rapidly to 500°-600° F. above the oven temperature. This peaking of temperature in the smoke eliminator duct has been employed in the past as an indicator of the concentration of incompletely-oxidized components in the oven effluent and of the progress of the oven cleaning process. The correlation, however, has been found not good enough to provide a basis for satisfactory control, whereby the oven cleaning process can be terminated at a time related to the temperature peaking within the smoke eliminator duct.

As a result of the above uncertainties, present pyrolytically operated self-cleaning ovens require widely variable times, for example, from 1 to 4 hours, from the start of the cleaning cycle to completion of the conversion of all soil to either volatile material that escapes through the smoke eliminator or ash which is easily removed by wiping. The cleaning time can also vary within the same oven, operating from the same power source, because of different soil conditions, soil composition and prior bake-on history. Therefore, the user must estimate cleaning time requirements from past experience and observation of the oven soil conditions. In practice, this results in the use of much longer cleaning time settings than may be actually required. The user commonly learns and adopts the practice of always using a time setting equal to the longest time requirement that was ever encountered. Consequently, it is easily possible to waste two or more hours of cleaning energy on most cleaning runs that do not require maximum cleaning time. For a conventional oven, approximately 7 kilowatt hours would be wasted with this unnecessary extra cleaning.

Prior art pyrolytic cleaning systems are also subject to a condition known as smoke eliminator overload. Thus, the capacity of a smoke eliminator to convert undesirable partial pyrolytic effluent to a more desirable pyrolytic end product like carbon dioxide and water vapor is a function of temperature, oxygen availability and effluent dwell time in the smoke eliminator. In practical designs, it is possible for some oven soil conditions to produce effluent flow rates which exceed the smoke eliminator capacity and permit a substantial amount of effluent to pass through the smoke eliminator and into room atmosphere without being converted to pyrolytic end-products. The most serious cause of the smoke eliminator overload condition is that the smoke eliminator temperature is too low for effective oxidation at the time the first volatile effluent product arrives from the oven in the initial oven heat-up phase of the cleaning cycle. Since this first large influx of effluent tends to occur for oven temperatures in the 400°-500° F. range, the smoke eliminator duct temperature will then be in about the 500°-700° F. range. This is several hundred degrees too low for efficient oxidation of the effluent without a catalyst. This type of smoke eliminator overload early in the cleaning cycle is quite common because it can occur even when the oven is only lightly soiled.

In addition to the considerations given above, the time required to pyrolytically clean an oven varies widely with other parameters, e.g. oven manufacturing tolerances, such as the temperature limit switch deadband and the oven door gap. The temperature limit switch is necessary to keep maximum oven temperature below limits set to protect the temperature sensors and the porcelain oven lining and to prevent excessive external oven surface temperatures. These limits are only a few degrees above the minimum temperatures required for rapid pyrolyzation of carbon-rich food soil.

SUMMARY OF THE INVENTION

In accordance with the present invention, a reducing gas sensor is located near or in the smoke eliminator duct and produces an output which is related to the content of incompletely oxidized or partial pyrolytic products in the oven cleaning process effluent.

The reducing gas sensor has an electrical output which is present so long as food soil is being decomposed in the cleaning process. This output will decrease to some low predetermined value when the cleaning is completed or is near completion. Once the measured value of the incompletely-oxidized partial pyrolytic products in the oven cleaning process effluent reaches a sufficiently low value, following a sufficiently long cleaning time, it is known that the oven is acceptably clean, and the oven cleaning process is automatically terminated. Thus, the termination of the oven cleaning process is related to the completion of pyrolytic cleaning of the oven, rather than termination always occurring after some arbitrary fixed oven cleaning time set by the user of the oven or built into the oven timer.

The gas sensor may be located either ahead of the smoke eliminator heater and in the oven effluent exhaust path or on the lower-temperature room-atmosphere side of the smoke eliminator heater. When the sensor is placed on the oven side of the smoke eliminator path, the sensor will be exposed to the relatively high interior oven temperatures and must be of a type which can withstand these higher temperatures. Such sensors could be of the noble metal type, contained within a suitable ceramic housing. Semiconductor type sensors can also be used if they are packaged to withstand long periods of operation at the ovencleaning limit temperature of about 900° F.

The gas sensor may also be mounted in the lower temperature location at the outlet side of the smoke eliminator outlet but the sensor is then exposed to the effluent after it has been further processed by the smoke eliminator heater. Thus, the application of the sensor is complicated by the continued processing of the effluent by the smoke eliminator, but less-expensive commercially-available gas sensors can be used.

It has been found that near the end of the cleaning cycle, when duct-mounted gas sensors may detect relatively small changes in oven effluent composition which accompany the completion of the cleaning process, the smoke eliminator is operating at its peak efficiency. This is because the heater is at its limit temperature and the low concentration of effluent at the end of the cleaning period does not overload the smoke eliminator. Hence, a gas sensor in the outlet duct of the smoke eliminator must be sufficiently sensitive to detect low concentrations of unoxidized oven effluent even after the smoke eliminator has further oxidized it under conditions of maximum smoke eliminator efficiency. However, it has been found that even relatively insensitive but commercially-available gas sensors can be used in the above-described application simply by relating the completion of cleaning directly to the time when the gas sensor response first decays below a predetermined threshold.

When the output of the gas sensor(s) is processed by microcomputer-type systems, a complete algorithm can be employed to improve the performance of the automatic termination system, which algorithm is tailor-made to the particular oven design used. These algorithms can be based on the time-rate-of-change of gas sensor response, with oven cleaning completion related to a fixed or adjustable time after the rate of sensor response decline falls below a threshold. This approach avoids the need for compensating for sensor-to-sensor sensitivity differences. Note, however, that microcomputer control is only one type of control which could be employed. Conventional electromagnetic relay controls can also be operated by the gas sensor outputs in order to terminate oven cleaning as desired when the gas sensor output decays to below a given value following a given time delay.

To increase the sensitivity of the gas sensor at the outlet of the smoke eliminator duct toward the end of the cleaning cycle, it is possible to turn the smoke eliminator heater off late in the oven cleaning cycle when the effluent is not highly charged with volatile partial pyrolytic products. In this way, the gas sensor, located in an area cooler than the interior of the oven, will receive effluent which is not influenced by the smoke eliminator heater.

In a further embodiment of the invention and in order to control smoke eliminator overload, when the gas sensor output is high enough to indicate an overload condition, the oven heater power may be reduced thereby to reduce the volume of effluent being produced. Once the sensor indicates the end of the overload condition, full oven heater power is restored.

Since smoke eliminator overload is frequently caused because the smoke eliminator heater is not up to its efficient operating temperature before significant oven effluent is produced by the cleaning system, the smoke eliminator may be provided with means to increase the smoke eliminator heater power to provide a smoke eliminator duct temperature of close to 900° F. when the oven temperature first reaches about 400° F., at which oven temperature high oven effluent flow rates are likely to begin. Means are also provided to reduce smoke eliminator heater power after the smoke eliminator has reached its most efficient operating temperature so that a 500° F. temperature differential between smoke eliminator and oven is not continuously maintained.

Accordingly, it is an object of the present invention to provide novel self-cleaning ovens and controls therefor.

This and other objects of the present invention will become apparent upon consideration of the following detailed description, when read in conjunction with the drawings.

DETAILED DESCRIPTION OF THE DRAWINGS

Figure 1:
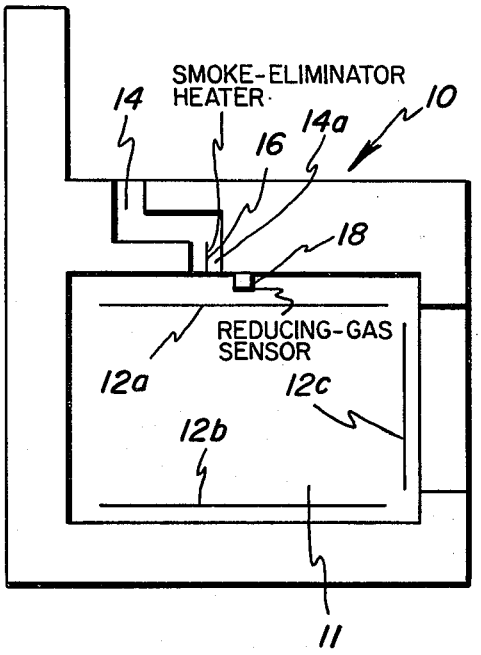
FIG. 1 is a schematic side sectional view of an oven capable of being pyrolytically cleaned and schematically illustrates the smoke eliminator structure and a reducing-gas sensor located at the oven cavity end of the smoke eliminator duct.

Referring first to FIG. 1, there is schematically illustrated a conventional cooking oven 10 which has an oven cavity 11 which contains conventional electrically energizable oven cavity heaters 12*a*, 12*b* and 12*c*. The interior walls of the cavity 11 may be procelain enamel which can withstand application of pyrolytic cleaning temperatures which may be as high as 900° F.

Heating element 12*a* may be an upper broiling heater element and heater 12*b* may be a lower baking element, when the oven is used in its normal cooking modes. Heating element 12*c* may be a mullion heater, used to raise the temperature of cold spots around the oven door, to insure a substantially uniform cavity temperature during an oven-clean cycle. The oven illustrated may also have a standard cook top if desired.

A smoke eliminator duct 14 extends from the interior of the oven cavity 11 to the external room atmosphere. A conventional electrically energizable heater 16 is disposed within the smoke eliminator duct 14.

In accordance with the invention and in order to measure the state of cleaning of the oven, a reducing-gas sensor 18 is provided within cavity 11, adjacent to the input end 14*a* of duct 14. The gas sensor 18 of FIG. 1 can be, for example, a sintered n-type semiconductor bulk device mainly comprised of tin oxide, whose conductivity increases in the presence of various gases or vapors of the kind contained in the effluent produced in oven cavity 11 during a cleaning operation. The sensor 18 is appropriately arranged, as will be later described, to produce an output voltage related to the concentration of partial pyrolytic products in the oven effluent. Reducing-gas sensors of this type are well known. By way of example, the gas sensor may be a Figaro gas sensor TGS No. 812 manufactured by Figaro Engineering Inc., and having a nylon housing.

When the gas sensor 18 is mounted within the oven cavity 11, as shown in FIG. 1, the nylon housing should be replaced with a ceramic housing, as in the Figaro TGS No. 816 gas sensor, so that oven temperatures as high as about 900° F. can safely be withstood.

Figure 3:
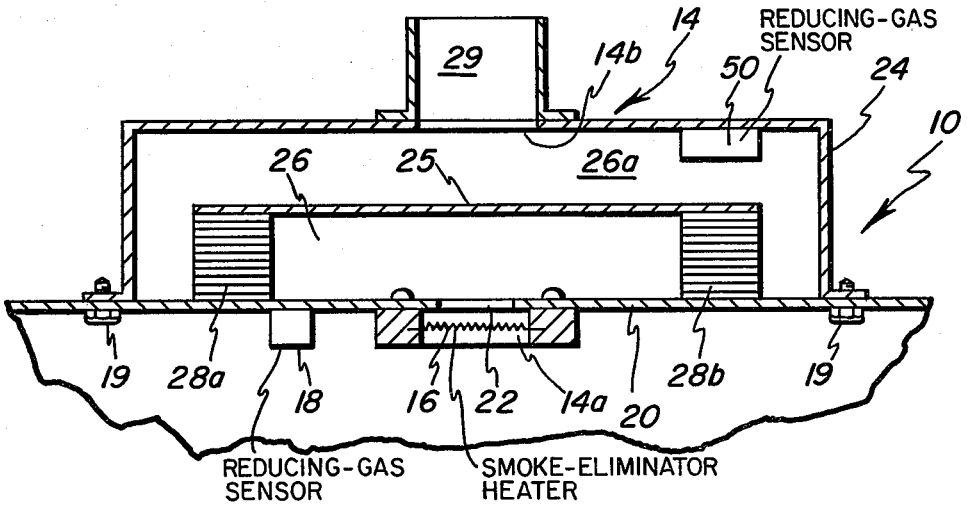
FIG. 3 is a cross-sectional view of a typical prior art smoke eliminator structure which could be used for the ovens of FIGS. 1 and 2 and shows the novel gas sensors in alternate locations on the oven side and on the room side respectively of the smoke eliminator duct.

The smoke eliminator structure can take the form of the prior art structure shown, for example, in FIG. 3 which shows the smoke eliminator disclosed in U.S. Pat. No. 3,536,457 in the name of Henderson entitled "Catalytic Oxidation Unit for Domestic Oven Exhaust", issued Oct. 27, 1970 and assigned to the assignee of the present invention. Referring to FIG. 3, the smoke eliminator can be suitably secured, as by bolts 19, to the top wall 20 of oven 10, adjacent to and over a wall opening 22. The duct 14 is partly defined by a metallic cap 24 which encloses the opening 22. A plate 25 encloses a volume 26 so that flow of gas from the interior oven 10 through the opening 22 must pass through perforated blocks 28*a* and 28*b* of thin-walled cellular construction. If desired, blocks 28*a* and 28*b* may be coated with a catalyst to assist in oxidizing pyrolytic products in the effluent being treated. Effluent then flows through plenum 26*a* and thence through external duct 29 to the exterior atmosphere.

The smoke eliminator heater in FIG. 3 consists of the heater coil 16 which extends across opening 22 in FIG. 3 and which may be a conventional electrically-heated coil. Further details of the smoke eliminator may be had by reference to U.S. Pat. No. 3,536,457.

Figure 4:
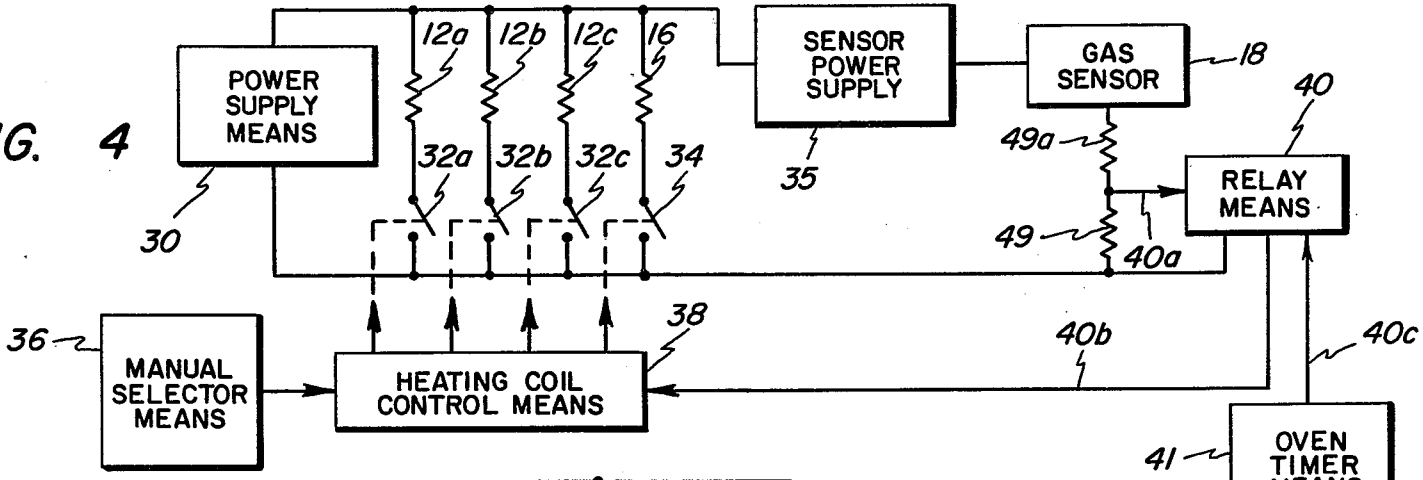
FIG. 4 is a schematic circuit diagram showing a first embodiment of the electrical energizing and control circuit for the components of the oven of FIGS. 1 and 2.

The components shown in FIGS. 1 and 3 are electrically connected as shown, for example, in FIG. 4. Referring to FIG. 4, a conventional power supply 30, which may be a nominal 220 volt 60 hz. power supply, is electrically connected to heater coils 12*a*, 12*b* and 12*c* and to smoke eliminator heater 16 respectively via series connection with respective control switches 32*a*, 32*b* and 32*c* and 34. If desired, heaters 12*c* and 16 can be connected in series. Switches 32*a*–32*c* and 34 can be operated manually or automatically and individually or in unison by a suitable conventional manual selector means 36 and heating coil control circuit means 38 which will be later discussed. The manual selector means 36, operating through control means 38, can cause closing of any of the switches 32*a*–32*c* and 34 to select a desired cooking mode for the oven or the pyrolytic cleaning mode. The heating coil control means 38 also responds to outputs of the gas sensor system, as will be described.

Power supply 30 also energizes the power supply 35 for providing operating potential to the reducing gas sensor 18 and components which may be associated therewith for its operation. A single resistor 49 or a resistive divider of resistors 49 and 49*a* may be connected in series with the gas sensor system as shown. It should be understood that, because sensor 18 appears as a variable resistance, the operating potential can be either D.C. or A.C., and of any magnitude commensurate with the characteristics of the sensor and relay/microcomputer-ADC components chosen for the desired implementation. Series dropping resistor 49a was chosen to adjust ("scale" ) the sensor output signal magnitude to a particular desired maximum level.

The output signal of gas sensor 18, as measured at the node between resistor 49a and resistor 49, is applied to the input circuit 40a of a suitable electromechanical relay means 40. The output circuit 40b of relay means 40 will change state, from an open to a closed condition, when the voltage at relay means input 40a decreases below a given threshold. Preferably, relay means 40 is disabled for a given time ($T_{min}$) following the beginning of the oven cleaning operation. This time delay allows the oven to heat up to a temperature at which effluent begins to appear and raises the sensor output sufficiently to prevent premature actuation of relay means 40. The time delay is produced by an inhibit signal provided at relay inhibit input 40c and derived from a conventional oven timer means 41 after the time delay period (on the order of 10 minutes) lapses.

The output circuit 40b of relay means 40 is connected to the heating coil control 38 such that, when the relay switches due to the reduction of the gas sensor voltage below the threshold, the heating coil control means will open all of contacts 32a–32c and 34 to deenergize the heating coils 12a–12c and 16.

Figure 7:
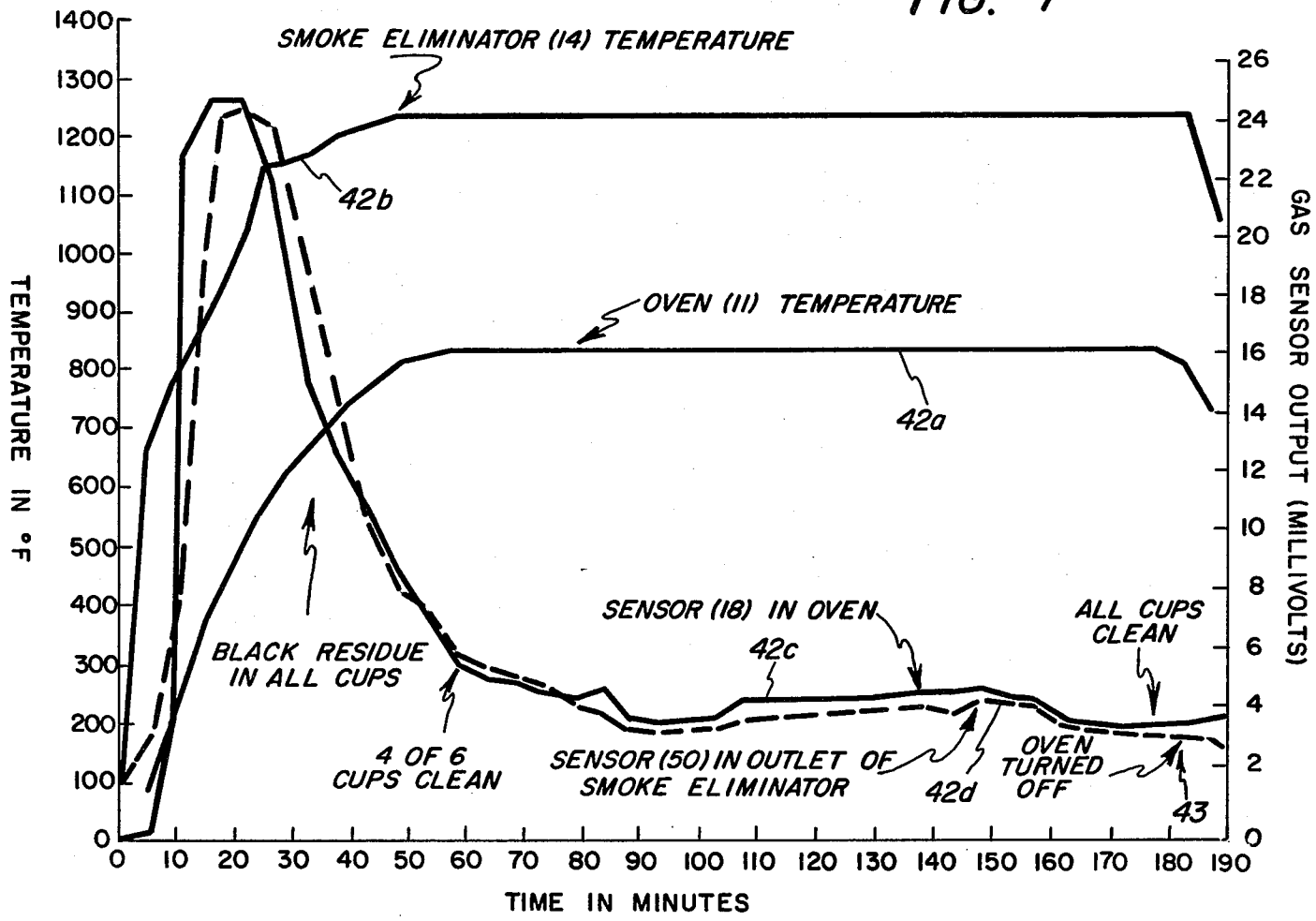
FIG. 7 graphically illustrates the oven temperature, smoke eliminator temperature and gas sensor output as a function of time for the ovens of FIGS. 1 and 2.

The operation of the arrangement shown in FIGS. 1, 3 and 4 can be best understood by reference to FIG. 7. In FIG. 7, curve 42a illustrates the temperature within oven cavity 11, with respect to time after a self-cleaning generation commences. The curve 42b illustrates the temperature in smoke eliminator duct 14 at a position adjacent to heater 16. The curve 42c illustrates the output voltage (right hand scale) of sensor 18, positioned in oven cavity 11 adjacent to duct inlet 14a and energized from a 5 V D.C. power supply 35. In an experiment from which the curves of FIG. 7 were derived, the interior of the oven 11 was loaded with six cups each filled with different kinds of soil. To start the pyrolytic oven cleaning operation, contacts 32a–32c and 34 were closed by the manual operation of selector means 36 operating through the heating coil control means 38. The temperature within oven cavity 11 then began to rise to 880° F., as shown in the initial portion of curve 42a. The smoke eliminator temperature also increased as shown in the initial portion of curve 42b and reached approximately 1,250° F., after about 50 minutes. The sensor voltage, at the node between resistors 49 and 49a, increased as shown in the solid line curve 42c and reached a peak output voltage after about 15 minutes, when the oven temperature reached approximately 400° F. and began to produce a copious amount of effluent from the soil load. Note that the smoke eliminator is not hot enough to be at peak efficiency, so that the effluent reaching sensor 18 is not substantially oxidized by heater 16. After about 35 minutes, the soil load in the six cups was inspected and a black residue was found in all cups. However, as shown in the solid line curve 42c voltage output of voltage sensor 18, the impurity content in the effluent passing the sensor 18 was decreasing, so that its effective output voltage decreased appropriately. At the end of approximately 60 minutes, the output voltage of sensor 18 was substantially reduced and four of the six cups loaded with soil were found to be clean. With continued operation of the oven at its high temperature of 880° F., the cleaning process continued for approximately 180 minutes after the beginning of the cycle. The oven was then turned off, at point 43 and it was observed that all cups were completely clean.

For automatic operation, the circuit of FIG. 4 is arranged so that relay means 40 receives a threshold crossing signal when the sensor output voltage at the sensor node between resistors 49 and 49a is reduced below a given value. By way of example, when the sensor node output voltage is at a value of about 4 millivolts at about 90 minutes into the cleaning cycle, the relay threshold can be crossed. Relay means 40 may be disabled by a signal from timer means 41 for the $T_{min}$ period, for example a period of 10 minutes, to assure that the oven cannot turn off either prematurely or just after the cleaning process starts. The remaining ash in all cups can then be easily swept away and remaining soil, if any, at the 90-minute time is acceptably small.

Figure 5:
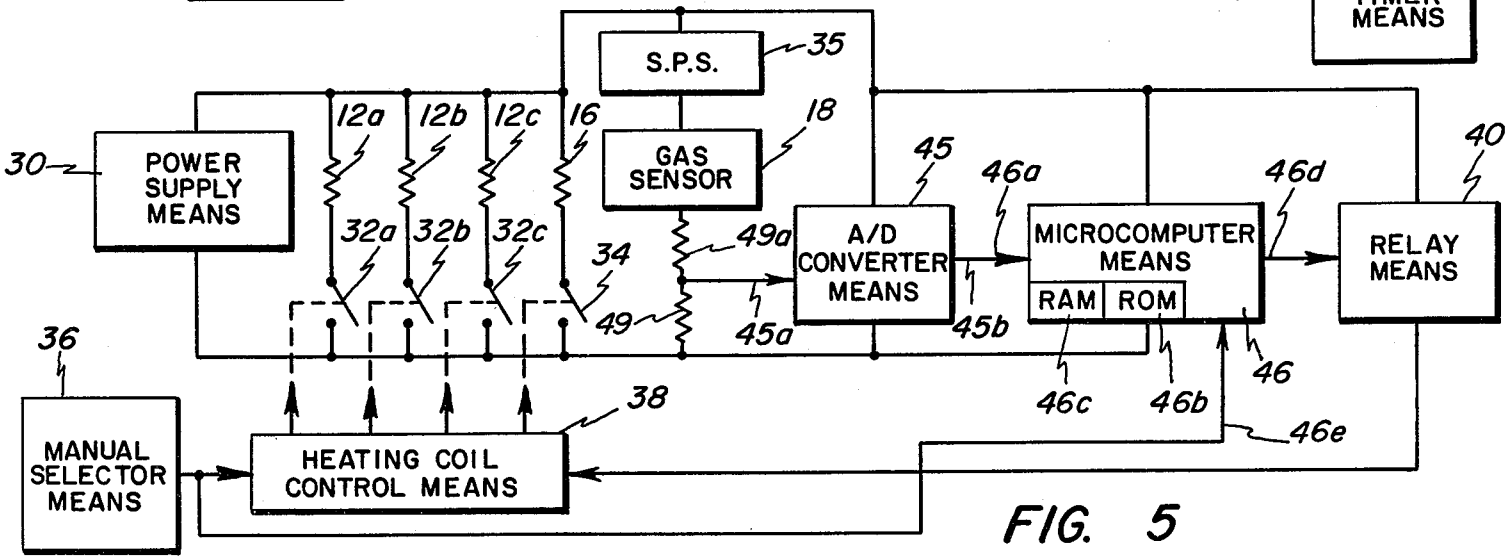
FIG. 5 is a schematic circuit diagram similar to that of FIG. 4, but implemented with microcomputer control.

The circuits shown in FIG. 4 could also be implemented by microcomputer control as schematically shown in FIG. 5. In FIG. 5, components identical to those of FIG. 4 have been given similar identifying numerals. It will be noted in FIG. 5 that the sensor node output signal, at the node of the resistors 49/49a, is applied to the analog voltage input 45a of an analog-to-digital converter ADC means 45, which is of conventional design. The digital output 45b of the ADC will then supply a digital data signal to an input port 46a of a suitable microcomputer 46. The microcomputer includes the necessary read-only memory (ROM) 46b, in which a directive program is stored, and random-access (RAM) read-write memory 46c, for at least temporarily storing the digital data received at input port 46a; ROM 46b, RAM 46c and A/D converter means 45 may be external or internal to the microcomputer. Typical microcomputers useful in the system of FIG. 5 are the type 8048 (without internal ADC) and 8096 (with internal ADC) available from Intel Co. The user-selected mode data from manual selector means 36 may be provided to another input port 46e of the microcomputer. When the microcomputer 46 determines, from the sensor output signal time history, that the cleaning process is complete, it will produce an output signal, at output port 46d, to cause relay means 40 to turn off power to the oven and smoke eliminator heaters, thus terminating the cycle.

Figure 2:
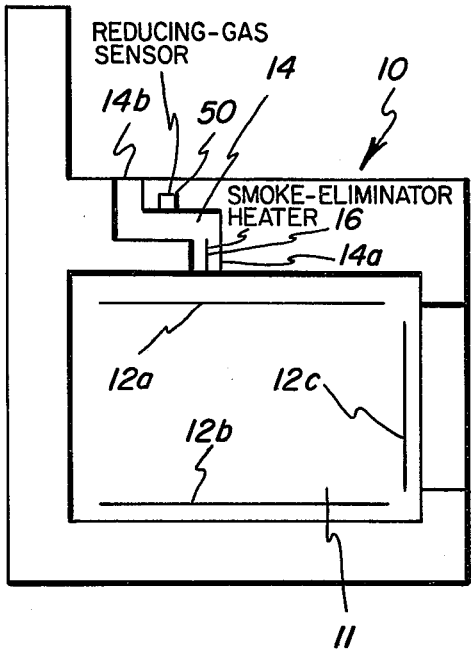
FIG. 2 is similar to FIG. 1 and shows the gas sensor located toward the outlet of the smoke eliminator duct.

FIG. 2 shows a second embodiment of the invention wherein a gas sensor 50 is provided in the outlet portion 14b of the smoke eliminator duct 15. Thus, a gas sensor 50 is located as in FIG. 3, in the plenum 26a, which is external of the members 28a and 28b, where the temperature will be substantially lower than at the location of gas sensor 18 of FIG. 1. Gas sensor 50 may be the same as the gas sensor 18 but it can retain the standard nylon housing provided with presently-commercially-available sensors. Moreover, other materials can be selected for the gas sensor 50 since its temperature requirements are not as rigorous as those of the gas sensor 18.

When placing sensor 50 on the outlet side 14b of the smoke eliminator, the same circuits as those shown in FIGS. 4 and 5 may be used for oven control. However, the circuit sensitivity must be increased since the sensor 50 is exposed to the oven effluent after the oven effluent has been further oxidized by the heater 16. Consequently, the sensor 50 receives a lower oven effluent impurity concentration than sensor 18. Adjustment of resistor 49a and/or an increase in the magnitude of the operating potential from sensor power supply 35, is generally required under these conditions of operation.

In tests of systems employing the sensor 50 in the outlet side of the smoke eliminator duct, the sensor output voltage (at the node 50*a* between resistors 49 and 49*a*) was that shown in the broken line curve 42*d* of FIG. 7. Toward the end of the oven cleaning cycle, the output voltage of sensor 50 will be flatter than that of sensor 18, thus making it more difficult to mark a threshold safe turn-off point for the oven. However, essentially the same timing can be employed and the same threshold voltage employed for initiating the turn-off procedure when using the sensor 50 as was used for sensor 18.

Figure 6:
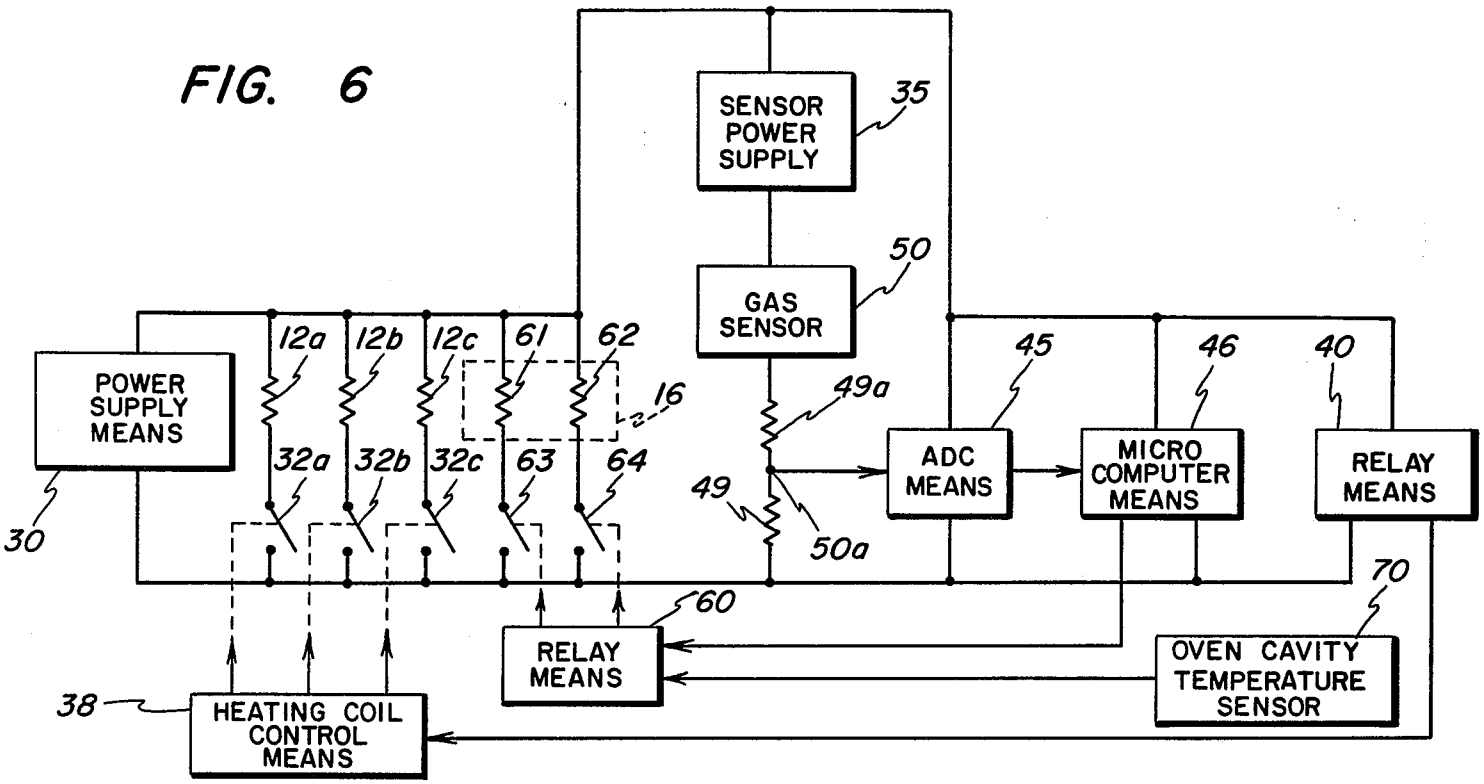
FIG. 6 is a circuit diagram of a further embodiment of the invention employing plural smoke eliminator heaters which can be selectively connected and disconnected from the power source and an oven temperature sensor.

FIG. 6 shows a control circuit similar to that of FIG. 5 with the sensor 50 replacing sensor 18 of FIG. 5. All components in FIG. 6 which are identical to those of FIGS. 4 and 5 are given identical identifying numerals. In the control circuit of FIG. 6, the single smoke eliminator heater 16 of FIG. 5 and its control switch 34 are replaced by two heater coils 61 and 62 which have control switches 63 and 64, respectively. Switches 63 and 64 are contacts of a relay means 60 which is operated by microcomputer 46 or by other control circuitry as will be later described. Relay means 60 is also operated in response to an oven cavity 11 temperature sensor 70 as will be later described.

Figure 8:
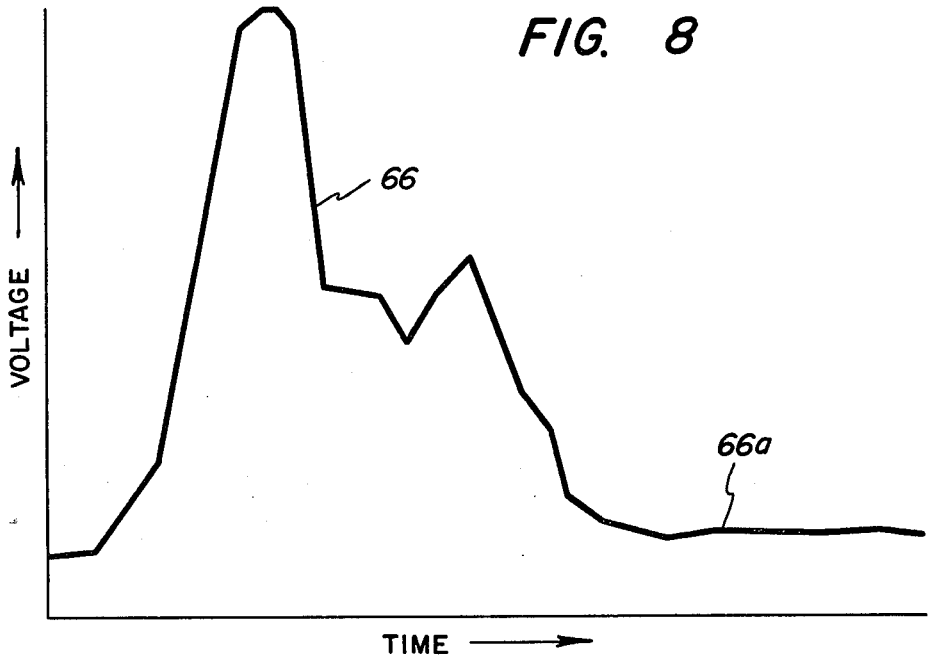
FIG. 8 shows another graph illustrating the gas sensor output voltage versus time for the oven of FIG. 2.

FIG. 8 is a curve 66 of the gas sensor output voltage at the node 50*a* of the gas sensor 50, i.e. node 50*a* is between resistor 49*a* and resistor 49 in FIG. 6. In region 66*a*, toward the end of the cleaning process, the output voltage is very flat. One of the reaons for this very flat sensor output voltage is that toward the end of the cleaning cycle, the heater 16 in the smoke eliminator has reached its rated temperature and has become more efficient than in the beginning of the cleaning cycle. Thus, relatively little unoxidized effluent passes heater 16.

In accordance with a further feature of the invention and to increase the sensitivity of temperature sensor 50, the smoke eliminator heater coil 16 (or coils 61 and 62, if used) is turned off when the cleaning cycle is well under way and after relatively little oven effluent is being generated in cavity 11.

While the control is shown in FIG. 6 to be a microcomputer control, a relay scheme could be employed if desired. A relay scheme will be later described in connection with FIG. 10.

In FIG. 6, the analog output of the gas sensor 50 is converted to a digital data input for microcomputer 46. The selected microcomputer 46 is suitably programmed (see FIG. 5*a*) so that after user mode selection, which may be by means of the manual selector means 36 (not shown in FIG. 6, but see FIG. 5), a first program step A determines if the user has requested the oven-cleaning CLEAN mode. If the CLEAN mode has not been selected, first decision step A exits to a second decision step B, and a determination as to whether the user has selected one of the normal COOK modes is made. If decision step B determines that a COOK mode has not been selected, after decision step A has determined that the CLEAN mode is also unselected, an operating mode of the oven has not been selected and step B exits through a "no action" step C and returns to the input of step A after a predetermined delay $T_{DO}$, to again check the user-selected mode. If decision step B determines that a COOK mode was selected, a third decision step D determines if the sensor node voltage V is greater than a predetermined fixed level $V_3$ (e.g. illustratively about 25 millivolts) which is the sensor voltage indicative of excessive effluent leaving oven cavity 11 during a cooking process. If voltage V is greater than the predetermined voltage $V_3$, step D exits through step E, and contacts 63 and 64 are closed, to energize smoke eliminator heaters 61 and 62. After closure of contacts 63 and 64, the program returns to the input of step D and again checks the sensor output voltage, whereby the smoke eliminator heater is maintained in the actuated condition as long as excessive effluent is in the smoke eliminator duct. If excessive effluent from the cooking process was not in the eliminator duct, or if the duct is eventually cleared of effluent by action of the eliminator heaters 61 and 62, step D exits to step F, wherein contacts 63 and 64 are opened and smoke eliminator heaters 61 and 62 are de-energized. Upon completion of step F, the program returns to the input of step B; the return to step B allows a determination to be made as to whether the oven is still operating in the cook mode (or if the oven has been turned off) prior to a next-subsequent comparison of the sensor node voltage V with the predeterminately-fixed voltage $V_3$. In this manner, the amount of effluent issuing from the smoke eliminator duct can be continually monitored and controlled during a cooking mode of operation.

Figure 9:
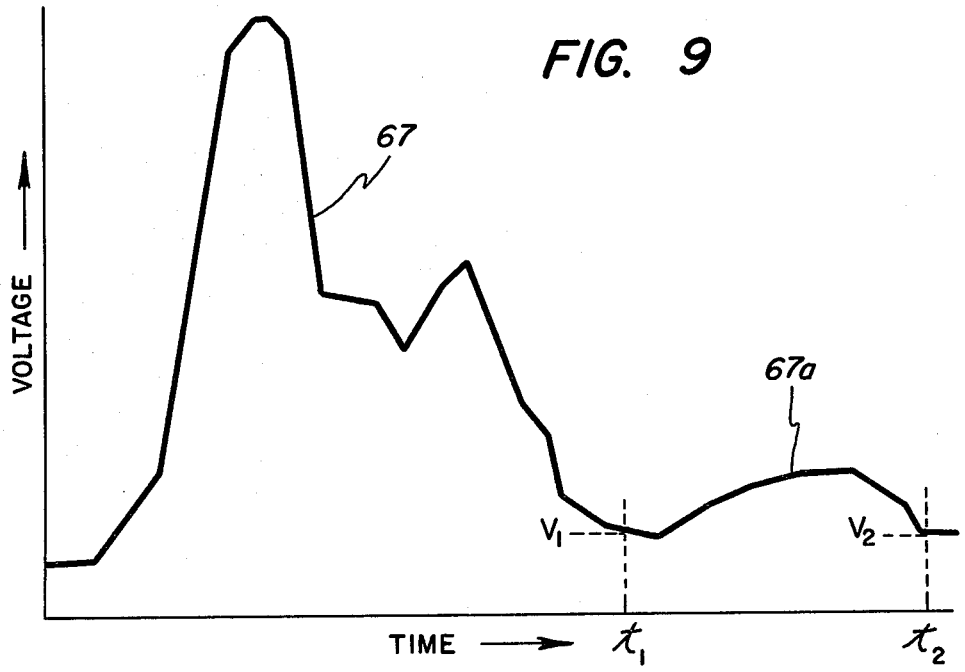
FIG. 9 shows another graph illustrating the gas sensor output voltage versus time for the oven of FIG. 2 when employing the control shown in FIG. 6, wherein the smoke eliminator heater is turned off toward the end of the cleaning cycle.

If, in step A, the CLEAN mode were selected, step G is entered and contacts 63 and 64 are closed to energize smoke eliminator heaters 61 and 62 at the beginning of the oven-cleaning process. After step G, a fourth decision step H is entered and the time T from the commencement of the cleaning cycle is determined (preferably by means of a timer and/or timing register forming a portion of the microcomputer means, in manner well known in the art). If the minimum time $T_{min}$ after clean cycle commencement, e.g. about 10 minutes in the illustrated embodiment, has not elapsed, step H exits to step I and no physical action is taken; a wait of $T_D$ seconds passes and step I returns to the input of decision step H to again compare actual elapsed time against the minimum time. If the comparison still indicates that the minimum time $T_{min}$ has not elapsed, step I is again entered, and, after waiting time $T_D$, the cycle returns to the input of step H. Eventually, the elapsed time will exceed the minimum time $T_{min}$ and decision step H exits to fifth decision step J. The oven temperature is monitored by suitable means (not shown, such as a thermocouple and like means known to the art providing temperature information to the microcomputer means 46) and compared to a first temperature $T_1$. This first temperature $T_1$, (e.g., at 800° F.) is the temperature at which the oven cavity temperature curve 42*a* of FIG. 7 flattens out. If the oven cavity temperature has reached temperature $T_1$, step J exits to step K and contact 64 is open to de-energize smoke eliminator heater 62, while smoke eliminator heater 61 is maintained in the energized position. After completion of step K, or if step J determines that the oven temperature has not yet exceeded predetermined temperature $T_1$ (requiring that both smoke eliminator heaters 61 and 62 remain energized), a sixth determination step L is entered. In step L, the sensor node voltage V is compared with the predetermined voltage $V_3$ indicative of a high effluent level in the smoke eliminator duct. If a high level is determined to exist, step M is entered and contact 64 is closed, energizing smoke eliminator 62 to reduce duct effluent concentration. After completion of step M, step L is again reentered and the sensor voltage is again checked. If the high effluent level continues to exist, the program loops through steps L and M until the effluent level is reduced such that the sensor node voltage V is no longer greater than predetermined voltage $V_3$. When this condition obtains, or if the initial comparison in step L found that the sensor node voltage was less than predetermined voltage $V_3$, step N is entered and contact 64 is opened to de-energize smoke eliminator heater 62. Thereafter, seventh decision step O is entered and sensor node voltage V is compared against a predetermined "near-completion" voltage $V_1$ (see FIG. 9). Thus, when the sensor node voltage V falls below predetermined voltage $V_1$, at a time after the minimum time $T_{min}$, the oven CLEAN process is nearing completion. If seventh decision step O finds that the sensor node voltage is not less than $V_1$, the CLEAN process must continue and step P is entered. In step P, a predetermined short waiting delay $T_D'$ occurs before the program returns and reenters fifth decision step J. If, in seventh decision step O, it is determined that the sensor output voltage V is less than the predetermined voltage $V_1$, step Q is entered and, as the oven CLEAN process is nearing completion, both of contacts 63 and 64 are opened, via relay means 60, to de-energize both smoke eliminator heaters 62. If desired, the program may operate upon the single contact 34 of a single heater 16, with contact 34 being respectively opened or closed whenever either, or both, of contacts 63 and 64 are indicated as being respectively opened or closed. Thus, the smoke eliminator single heater 16, or the two heaters 61 and 62, are turned off in step Q. Consequently, the oven effluent is now uninfluenced by the smoke eliminator heaters so that a higher concentration of unoxidized effluent will reach the sensor 50. Therefore, as shown by curve portion 67*a* in FIG. 9, the output of the sensor 50 increases after time $t_1$ and is more sensitive to the actual effluent concentration coming from the oven 11. As the concentration of unoxidized products in the effluent reduces with continued oven cleaning, the sensor node output voltage V again decreases. The eighth comparison step R is now entered and the sensor node voltage V is compared against the predetermined value of voltage $V_2$, e.g. 4 mV in the example. If node voltage V is greater than predetermined voltage $V_2$, step S is entered, no physical action is taken and after a wait of time $T_D''$, step R is again entered. The program cycles through steps R and S until the sensor node voltage V is less than level $V_2$, indicating that the oven cleaning operation is completed. The microcomputer 46 detecting the reduction of sensor node voltage to the low threshold voltage $V_2$ at time $t_2$, folllowing turn-off of the heaters at time $t_1$, enters step T. Thus, at time $t_2$ microcomputer 46 will operate relay means 60 (or relay means 40 if the single heater configuration of FIG. 5 is used) which in turn operates the heating coil control means 38 to deenergize the heating coils 32*a*–32*c* and 34, enter step U and terminate the CLEAN cycle.

As indicated in the program flow chart and description hereinabove, a further embodiment of the invention is also disclosed in FIG. 6, whereby the circuit can operate to automatically prevent smoke eliminator overload. Thus, as pointed out earlier, under come conditions of heavy soil, the effluent produced from the oven 11 is sometimes produced at a rate too great for the smoke eliminator to fulfill its purpose of preventing the venting of unoxidized effluent into the room atmosphere. This condition exists even under light soil conditions early in the cleaning cycle before the smoke eliminator heats up to its preferred operating temperature range.

When the smoke eliminator is overloaded, the condition will be indicated by a sensor node output voltage V greater than some predetermined value $V_3$. The microcomputer 46, or an equivalent relay circuit, can be implemented so that when this high output voltage $V_3$ is sensed, the relay means 40 or 60 switches to turn off the heating coils 12*a*–12*c* through the heating coil control means 38, while energizing smoke eliminator heater coil 16 or coil blend 62. Coils 12*a*–12*c* remain off until the gas sensor output of sensor 50 decreases to a value $V_4$ low enough to indicate that the overload has disappeared, and the coils 12*a*–12*c* are reenergized.

Figure 5A:
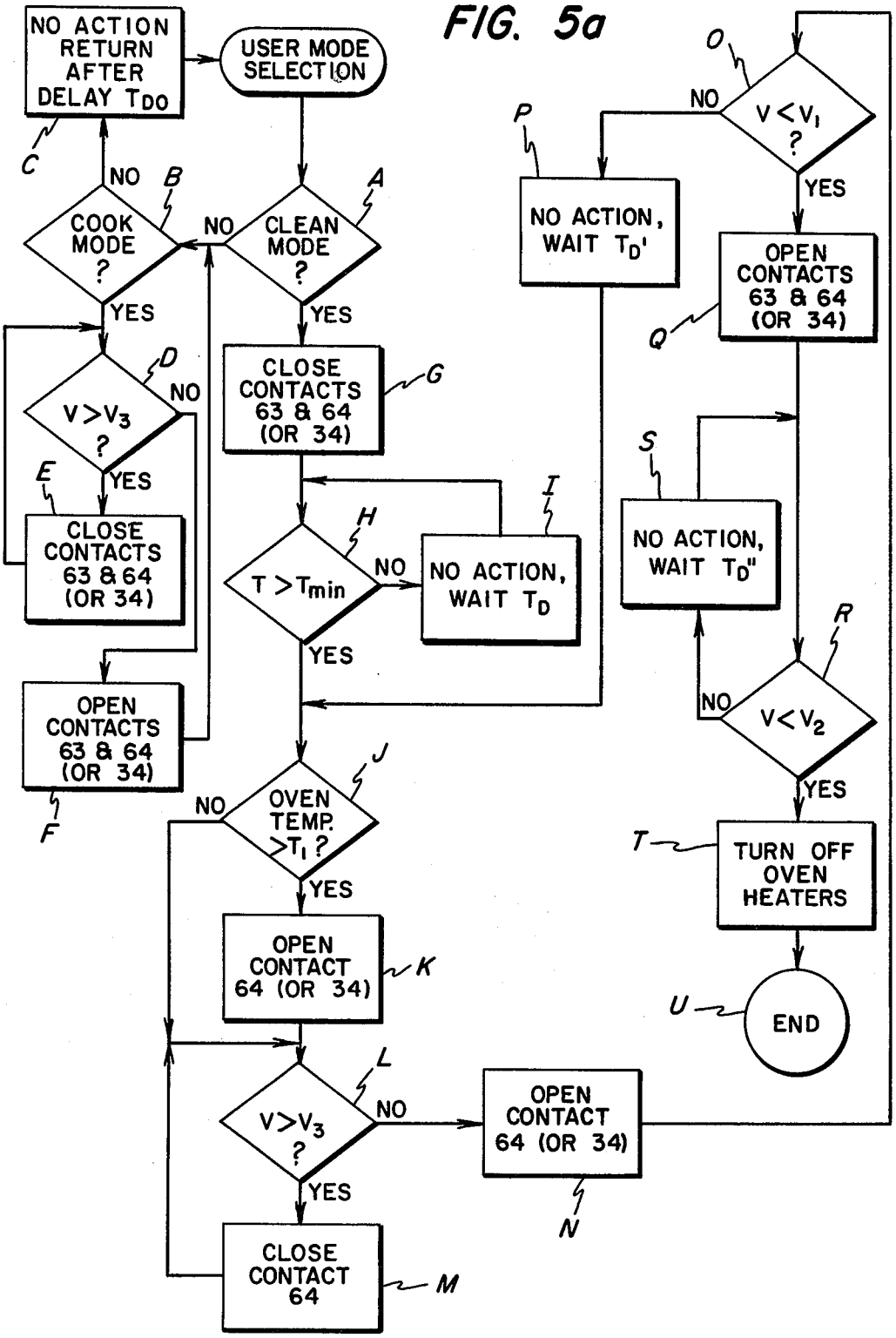
FIG. 5*a* is a flow chart illustrating the programming of the microcomputer.

The control system of FIG. 6 can also be employed during the cooking mode of operation, also as noted in the program flow chart of FIG. 5*a*. During the cooking mode, heaters 12*c* and 16*c* or heaters 16 and 61 and 62 are normally deenergized. In accordance with the invention, however, if during the cooking mode, the gas sensor 50 monitors an effluent greater than a given amount, the microcomputer 46, operating through relay means 60 as shown in steps D–F of FIG. 5*a*, causes the turn-on of the smoke eliminator heater 16 to cause oxidation of the excessive effluent. Obviously, in range controls that do not have a microcomputer, the functions referred to above could be implemented with relays and user-actuated switches, as will be later described.

In accordance with still another embodiment of the invention and as shown in FIG. 6, the smoke eliminator heaters 61 and 62 can be individually and selectively operated. Thus, the microcomputer 46 and relay means 60 can operate so that during normal cleaning operation, only contact 63 is closed and only heater 61 is energized. If, however, an overload condition is measured (as at program step L if a microcomputer is used), the smoke eliminator heater power can be increased by closing contact 64 and energizing heater 62, in addition to heater 61 (as at step M). The smoke eliminator efficiency will then more rapidly increase and reduce the amount of effluent being injected into the room atmosphere. However, at such time in the oven cleaning cycle as the oven cavity temperature reaches its limit temperature, as measured by oven cavity temperature monitor 70 connected to relay means 60, the heater 62 can be turned off to avoid the possibility of producing undesirably high smoke eliminator temperatures (as, for example, in steps J and K of the program if under microcomputer control).

By providing two heaters 61 and 62 for the smoke eliminator, the smoke eliminator temperature can be rapidly increased at the beginning of the clean cycle. Thus, as shown in curve 42*b* of FIG. 7, the smoke eliminator temperature, using a single heater, rises to its most effective level after about 50 minutes. The low efficiency time occurs when the greatest amount of effluent is produced in the oven 11. By providing two separate heaters 61 and 62, it is possible to energize both at the beginning of the heating cycle so as to increase the smoke eliminator temperature more rapidly. However, in order to prevent too great a temperature difference between the smoke eliminator and the oven, after the smoke eliminator has come up to its optimum operating temperature, microcomputer 46 operates relay means 60 to open contact 64, so that heating coil 61 is turned off (see steps J and K).

Figure 10:
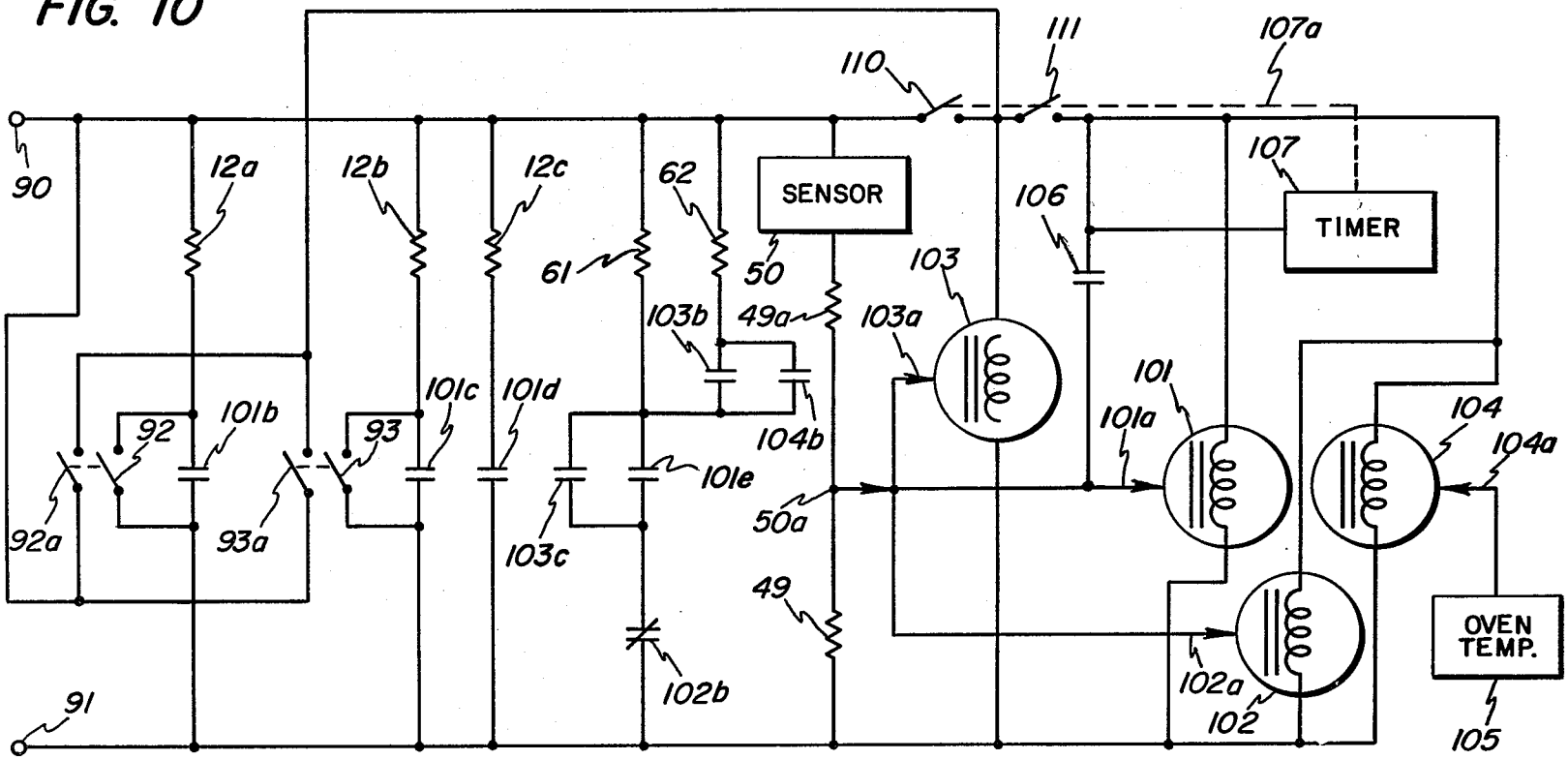
FIG. 10 is a schematic diagram of a relay circuit for carrying out the controls described in connection with FIG. 6.

FIG. 10 shows a relay scheme for carrying out the control functions of FIG. 6 and replaces the microcomputer type control which is shown in FIG. 6. Referring to FIG. 10, a suitable a-c power supply is connected to terminals 90 and 91 and is used to energize the heaters 12*a*, 12*b* and 12*c* within the oven cavity and the smoke eliminator heaters 61 and 62. In addition, the power from terminals 90 and 91 is provided to sensor 50 and resistor 49 for energizing the various relays which will be described. Manual controls are provided for the normal use of the oven and typically include the broil element contact 92 and bake element contact 93 which can be manually closed to energize the broil element 12*a* and bake element 12*b*, respectively. When either contact 92 or contact 93, or both, are closed, the linked associated contacts 92*a* and 93*a* also close, to form a "cook" contact link to enable energization of an effluent overload relay, as will be later described.

The system as disclosed in FIG. 10 has four input-/output type relays 101–104, which are conventional relays which may contain contacts which are switched between open and closed positions when a signal of some predetermined magnitude is applied to the associated relay input terminals 101*a*–104*a*.

Relay 101 has contacts 101*b*, 101*c*, 101*d* and 101*e* which are normally-open contacts connected in series with heaters 12*a*, 12*b*, 12*c* and 61–62, respectively. Relay 101 is arranged so that its normally-open contacts will close when the sensor 50 output voltage, at node 50*a* and applied to relay input 101*a*, is greater than the sensor node voltage $V_2$, e.g., about 4 millivolts, and will open when a voltage less than $V_2$ of about 4 millivolts, is applied to input 101*a* from node 50*a*.

Relay 102 has a normally-closed contact 102*b* which is in a series with heaters 61 and 62. Relay 102 is arranged so that the contact 102*b* will be open from the voltage at input 102*a*, to the relay coil 102 from the sensor node 50*a* is less than voltage $V_1$, e.g. about 5 millivolts.

Relay 103 has normally-open contacts 103*b* and 103*c*. Contact 103*b* is in series with heater coil 62; contact 103*c* is in parallel with contact 101*e*. Relay coil 103 will operate its contacts 103*b* and 103*c* to a closed position when the voltage at its input 103*a*, from sensor node 50*a*, is greater than voltage $V_3$, e.g. about 25 millivolts.

Relay 104 is provided with a contact 104*b* which is connected in parallel with contact 103*b*. The relay 104 is operated by the output voltage of the oven temperature sensor 105 in such a manner that the normally-open contact 104*b* is closed when the oven temperature is less than the $T_1$ temperature, e.g. about 800° F.

A further normally open contact 106 is connected to the input relay coil 101. The contact 106 is closed by an appropriate timer means 107 so that timer circuit 107 can inject a signal greater than voltage $V_2$, e.g. about 4 millivolts, into relay 101 while contact 106 is closed, whereby relay 101 cannot become operative until after a given length of time $T_{min}$, for example about 10 minutes, after the beginning of the cleaning cycle.

Ganged manual switches 110 and 111 are provided for initiation of the cleaning mode of operation by closure thereof.

The operation of the circuit of FIG. 10 is as follows: the oven is placed in a cooking mode of operation by closure of either or both of switches 92 or 93 to enable the operation of the relay coil 103. Thus, during the normal (bake or broil) cooking operation, if excessive effluent is produced, which will produce an output voltage greater than $V_3$ (for example of greater than 25 millivolts) from the sensor 50, the relay coil 103 will cause closure of contacts 103*b* and 103*c* and smoke eliminator heaters 61 and 62 are energized. When the overload condition disappears, relay contacts 103*b* and 103*c* reopen and the smoke eliminator heater windings are deenergized.

If it is now desired to place the oven in its pyrolytic cleaning mode of operation, contacts 110 and 111 are manually closed. At the same time, timer 107 is activated (as by a mechanical connection 107*a* to contacts 110 and 111) so that contact 106 is closed. With the closure of contacts 106, 110 and 111, relay coil 101 is energized and its contacts 101*b*, 101*c*, 101*d* and 101*e* close. This causes the immediate energization of heaters 12*a*, 12*b*, 12*c* and 61. At the same time that the cleaning cycle is started, the relay coil 104 will be energized by the oven temperature sensor 105 since that oven temperature sensor will sense a temperature less than temperature $T_1$, e.g. about 800° F. Accordingly, its contact 104*b* is closed so that heater 62 is also energized from the main power line.

The oven cavity 11 then heats and the pyrolytic cleaning action is initiated. Note that both smoke eliminator heaters 61 and 62 are initially excited so that they will heat more quickly than with the single heater 61, so that the smoke eliminator becomes efficient at an early time in the cleaning cycle.

Once the oven temperature reaches temperature $T_1$ (800° F.) and in order to prevent too great a temperature difference between the smoke eliminator and the oven, the relay 104 is operated and its contact 104*b* opens to deenergize heater 62 so that only the single heater winding 61 is operative.

As the cleaning progresses, the effluent produced by the cleaning process contains a smaller amount of unoxidized product and toward the end of the cleaning cycle the output voltage at the sensor node 50*a* will decrease, for example, to less than voltage $V_1$, e.g. about 5 millivolts. At this time and in order to increase the sensitivity of the gas sensor, the relay coil 102 is operated to open its contact 102*b*. This then deenergizes the smoke eliminator heater winding 61 so that the effluent applied to the sensor 50 is unaffected by the continued oxidation caused by the smoke eliminator heater winding 61, when the sensor is used in the configuration of FIG. 2.

After further cleaning and once the output of sensor 50 has decreased to some predetermined low value $V_2$, for example 4 millivolts, it is determined that the interior of the oven is acceptably cleaned and the cleaning process may be terminated. Thus, the relay coil 101 is deenergized and all of its contacts 101*b*–101*e* are opened to deenergize all heater windings.

It should be noted that the coil 101 cannot be deenergized after the initiation of the cleaning cycle for some predetermined time $T_{min}$, for example 10 minutes, responsive to timer relay 107 having closed its contact 106; closure for the 10 minute period (or any other desired predetermined period) $T_{min}$ follows the closing of the contacts 110 and 111. As previously stated, timer relay 107 may also have means for applying a voltage substantially greater than voltage $V_2$ (4 millivolts) to the input of relay 101 so long as contact 106 is closed, to ensure deactivation of relay 101 for this predetermined length of time.

In the event that the smoke eliminator becomes overloaded during the cleaning operation, relay 103 will be energized, since the sensor node 50*a* voltage at its input 103*a* will exceed its $V_3$ (25-millivolt) operating input voltage. Energization of the relay coil 103 will cause the closure of contact 103*b* so that the full heating power of coils 61 and 62 will be applied to the smoke eliminator to better deal with the smoke overload condition.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A self-cleaning thermal oven and control therefor, comprising:

a thermal cooking oven cavity;

electrically-energizable means within said oven cavity for thermally heating the interior of said cavity to a temperature at least high enough to pyrolyze cooking soil within said cavity and convert said soil to an effluent capable of flowing out of said oven cavity;

a smoke eliminator comprising a passage, extending from the interior of said oven cavity to external atmosphere;

an electrically-energizable smoke eliminator heater disposed to heat effluent which flows from said thermal oven cavity and through said passage, said smoke eliminator heater being operable to oxidize partially pyrolyzed components in the effluent produced by said oven heater means;

a reducing gas sensor fixed relative to said smoke eliminator passage at a position before the end of said passage furthest from said oven cavity and exposed to at least a portion of said effluent which flows from said oven cavity and through said passage, said reducing gas sensor producing an electrical output related to the concentration of pyrolyzed products in said effluent; and electrical control means coupled to said oven thermal heating means for connecting and disconnecting power thereto, said reducing gas sensor being electrically coupled to said electrical control means to cause said electrical control means to disconnect power from said oven thermal heating means responsive to an output of said reducing gas sensor which is indicative of the completion of the oven cleaning process and of a pyrolyzed product concentration in said effluent which is less than a given amount.

2. The device of claim 1, wherein said electrical control means includes a microcomputer.

3. The device of claim 1, further comprising time-delay means connected to said electrical control means for preventing operation of said electrical control means for a given time following the initiation of a cleaning cycle.

4. The device of claim 1, wherein said sensor is mounted at the input side of said smoke eliminator passage and is directly exposed to effluent within said oven and before said effluent is heated by said smoke eliminator heater.

5. The device of claim 4, further comprising time-delay means connected to said electrical control means for preventing operation of said electrical control means for a given time following the initiation of a cleaning cycle.

6. The device of claim 1, wherein said sensor is mounted within a region of said smoke eliminator passage in which effluent reaching said sensor has flowed past said smoke eliminator heater.

7. The device of claim 6, further comprising time-delay means connected to said electrical control means for preventing operation of said electrical control means for a given time following the initiation of a cleaning cycle.

8. The device of claim 6, further comprising switching means connected to said smoke eliminator heater for connecting and disconnecting power thereto, said electrical control means further connected to said switching means to cause said switching means to connect power to said smoke eliminator heater during a cooking mode of operation only in response to an output from said sensor which is representative of an undesirably high rate of effluent flow.

9. The device of claim 6, further comprising switching means interacting with said electrical control means for disconnecting power from said smoke eliminator heater when the output of said sensor falls below a given value which is correlated to a low concentration level of said effluent, to increase the sensitivity of said sensor to pyrolytic products in said effluent from said oven cavity.

10. The device of claim 9, further comprising time-delay means connected to said electrical control means for preventing operation of said electrical control means for a given time following the initiation of a cleaning cycle.

11. The device of claim 6, further comprising: an electrically-energizable auxiliary smoke eliminator heater adjacent to said smoke eliminator heater; switching means connected to said auxiliary smoke eliminator heater for connecting and disconnecting power thereto; and an oven temperature sensor for measuring the temperature within said oven; said electrical control means being coupled to both said switching means and said oven temperature sensor to cause said switching means (a) to provide operating power to said auxiliary smoke eliminator heater when said oven temperature sensor indicates that said oven cavity is at a temperature which is relatively low and before said oven temperature has reached its normal operating temperature, and (b) to remove said operating power from said auxiliary smoke eliminator heater when said oven temperature sensor indicates that said a normal oven operating temperature is reached; said auxiliary heater also being provided with operating power in response to an output signal from said sensor indicator of a significant effluent flow through said passage.

12. A process for controlling the self-cleaning of a cooking oven cavity, comprising the steps of:

heating the interior of the oven cavity to a pyrolyzing temperature of about 900° F.;

heating a smoke eliminator heater, disposed adjacent to a smoke eliminator duct extending from the oven cavity to room atmosphere, to a pyrolyzing temperature for further pyrolyzing effluent issuing from the oven cavity and flowing through the smoke eliminator duct;

providing a reducing gas sensor at a position fixed relative to the smoke eliminator passage and before the end of the passage furthest from the oven cavity;

electrically measuring the partial pyrolytic product content of the effluent flowing through the duct by causing the effluent to flow over the reducing gas sensor; and electrically terminating the heating of the oven cavity when the pyrolytic content of the effluent measured by the reducing gas sensor indicates an acceptable oven-clean condition.

13. The process of claim 12, further including the step of: enabling the termination of the heating of the oven cavity only after a preselected time has elapsed from the initiation of the oven cleaning operation.

14. The process of claim 12, wherein the gas sensor is located adjacent to the inlet of the duct.

15. The process of claim 12, wherein the gas sensor is located in the duct downstream of the smoke eliminator heater.

16. The process of claim 15, further including the steps of: ceasing to supply heating energy to the oven cavity when the output signal of the gas sensor indicates a smoke eliminator overload condition; and again supplying heating energy to the oven cavity only when the output signal of the gas sensor indicates termination of the smoke eliminator overload condition.

17. The process of claim 15, further including the steps of: operating the oven cavity in a cooking mode; and operating the smoke eliminator heater in response to an output of the gas sensor indicative of an excess flow of effluent to room atmosphere.

18. The process of claim 15, further including the step of: reducing the heating of the smoke eliminator heater when the concentration of pyrolytic products in the effluent has decreased below a given value selected to prevent oxidation of the effluent by the smoke eliminator heater before the effluent reaches the gas sensor.

19. The process of claim 15, further including the steps of: rapidly increasing the temperature of the smoke eliminator heater during the time that the oven cavity temperature is less than a given temperature below 800° F.; and reducing the temperature of the smoke eliminator heater when the oven temperature exceeds the given temperature.

20. The process of claim 19, further including the step of: increasing the temperature of the smoke eliminator heater when the effluent concentration reaching the gas sensor is greater than a given value.

* * * * *